US011903425B2

(12) United States Patent
Leadley

(10) Patent No.: US 11,903,425 B2
(45) Date of Patent: Feb. 20, 2024

(54) SYSTEMS FOR GENERATING VAPOR FOR USER INHALATION

(71) Applicant: NICOVENTURES TRADING LIMITED, London (GB)

(72) Inventor: David Leadley, London (GB)

(73) Assignee: NICOVENTURES TRADING LIMITED, London (GB)

( * ) Notice: Subject to any disclaimer, the term of this patent is extended or adjusted under 35 U.S.C. 154(b) by 366 days.

(21) Appl. No.: 15/733,295

(22) PCT Filed: Dec. 19, 2018

(86) PCT No.: PCT/GB2018/053681
§ 371 (c)(1),
(2) Date: Jun. 22, 2020

(87) PCT Pub. No.: WO2019/122865
PCT Pub. Date: Jun. 27, 2019

(65) Prior Publication Data

US 2021/0093014 A1 Apr. 1, 2021

(30) Foreign Application Priority Data

Dec. 22, 2017 (GB) ..... 1721765

(51) Int. Cl.
*A24F 40/50* (2020.01)
*A24F 40/60* (2020.01)
(Continued)

(52) U.S. Cl.
CPC ..... *A24F 40/50* (2020.01); *A24F 40/46* (2020.01); *A24F 40/60* (2020.01); *A24F 40/10* (2020.01)

(58) Field of Classification Search
CPC ..... A24F 40/10; A24F 40/46; A24F 40/50; A24F 40/60
See application file for complete search history.

(56) References Cited

U.S. PATENT DOCUMENTS 11,388,931 B2 * 7/2022 Potter ..... A24F 40/46
2007/0045288 A1 3/2007 Nelson
(Continued)

FOREIGN PATENT DOCUMENTS

CN 101130121 A 2/2008
CN 202774133 U 3/2013
(Continued)

OTHER PUBLICATIONS

Office Action for Canadian Application No. 3,086,071, dated Sep. 14, 2021, 6 pages.
(Continued)

*Primary Examiner* — Abdullah A Riyami
*Assistant Examiner* — Thang H Nguyen
(74) *Attorney, Agent, or Firm* — Patterson, Thuente PA

(57) ABSTRACT

Described is provided a vapor provision system for generating a vapor for user inhalation, the system including a housing, a first user input mechanism configured to provide a first input to control a first aspect of vapor generation and located on a first side of the housing, and a second user input mechanism configured to provide a second input to control a second aspect of vapor generation and located on a second side of the housing, the second side of the housing opposite to the first side of the housing, wherein the first user input mechanism and the second user input mechanism are different types of user input mechanisms.

14 Claims, 4 Drawing Sheets

(51) Int. Cl.
*A24F 40/10* (2020.01)
*A24F 40/46* (2020.01)

(56) References Cited

U.S. PATENT DOCUMENTS

| | | | | |
|---|---|---|---|---|
| 2012/0325227 | A1* | 12/2012 | Robinson | A61M 16/108 131/328 |
| 2013/0037041 | A1 | 2/2013 | Worm et al. | |
| 2013/0333709 | A1* | 12/2013 | Shimizu | A24F 7/02 131/223 |
| 2014/0311503 | A1* | 10/2014 | Liu | A24F 40/00 131/329 |
| 2015/0122252 | A1 | 5/2015 | Frija | |
| 2015/0128967 | A1* | 5/2015 | Robinson | A24F 40/50 131/328 |
| 2016/0050975 | A1 | 2/2016 | Worm et al. | |
| 2016/0309787 | A1 | 10/2016 | Hawes et al. | |
| 2016/0324212 | A1 | 11/2016 | Cameron | |
| 2017/0042230 | A1 | 2/2017 | Cameron | |
| 2017/0042232 | A1 | 2/2017 | Gorilovsky | |
| 2017/0071257 | A1 | 3/2017 | Lin | |
| 2017/0150756 | A1* | 6/2017 | Rexroad | H05B 1/0244 |
| 2020/0154770 | A1 | 5/2020 | Hepworth et al. | |
| 2021/0084986 | A1 | 3/2021 | Hepworth et al. | |
| 2023/0087525 | A1* | 3/2023 | Tambo | A24F 40/42 392/390 |
| 2023/0224432 | A1* | 7/2023 | McKeon | H04N 21/4113 345/173 |

FOREIGN PATENT DOCUMENTS

| | | | | |
|---|---|---|---|---|
| CN | 104135880 | A | 11/2014 | |
| CN | 104432543 | A | 3/2015 | |
| CN | 204351068 | U | 5/2015 | |
| CN | 104839892 | A | 8/2015 | |
| CN | 105455198 | A | 4/2016 | |
| CN | 105611847 | A | 5/2016 | |
| CN | 106455716 | A | 2/2017 | |
| CN | 106455724 | A | 2/2017 | |
| CN | 205962830 | U | 2/2017 | |
| CN | 106998813 | A | 8/2017 | |
| CN | 107105776 | A | 8/2017 | |
| CN | 206413752 | U | 8/2017 | |
| CN | 206620829 | U | 11/2017 | |
| EP | 3097802 | A1 | 11/2016 | |
| EP | 3238554 | A1 | 11/2017 | |
| EP | 3727057 | B1 | 3/2022 | |
| JP | H1189551 | A | 4/1999 | |
| JP | 2014519850 | A | 8/2014 | |
| JP | 2015213516 | A | 12/2015 | |
| JP | 2017127300 | A | 7/2017 | |
| KR | 20140101728 | A | 8/2014 | |
| KR | 20160044712 | A | 4/2016 | |
| RU | 2015114091 | A | 12/2016 | |
| WO | WO-2014060268 | A1 | 4/2014 | |
| WO | WO-2014060269 | A1 | 4/2014 | |
| WO | WO-2015013950 | A1 | 2/2015 | |
| WO | WO-2015150068 | A1 | 10/2015 | |
| WO | WO-2016198266 | A1 | 12/2016 | |
| WO | WO-2018206940 | A1 * | 11/2018 | A24F 40/42 |
| WO | 2019003166 | A1 | 1/2019 | |

OTHER PUBLICATIONS

Office Action for Japanese Application No. 2020-529620, dated Jul. 6, 2021, 20 pages.
Office Action for Russian Application No. 2020120644, dated Dec. 4, 2020, 10 pages.
"Office Action received for Ukrainian Patent Application No. a202003557, dated May 8, 2023" (no English abstract available; concise statement of relevance is that this is an action issued in a counterpart foreign application to the instant application).
Decision to Grant received for European Patent Application No. 18829441.7, dated Feb. 10, 2022, 2 pages.
Intention to Grant received for European Patent Application No. 18829441.7, dated Oct. 14, 2021, 72 pages.
International Preliminary Report on Patentability received for PCT Patent Application No. PCT/GB2018/053681, completed on Nov. 27, 2019, 6 pages.
International Search Report and Written Opinion received for PCT Patent Application No. PCT/GB2018/053681, dated Feb. 12, 2019, 11 pages.
Notice of Allowance received for Korean Patent Application No. 10-2020-7017876, dated Dec. 21, 2022, 3 pages (1 page of English Translation and 2 pages of Official Copy).
Search Report received for Chinese Patent Application No. 201880082741.5, dated Nov. 17, 2022, 3 pages (Official Copy Only).

* cited by examiner

SYSTEMS FOR GENERATING VAPOR FOR USER INHALATION

PRIORITY CLAIM

The present application is a National Phase entry of PCT Application No. PCT/GB2018/053681, filed Dec. 19, 2018, which claims priority from GB Patent Application No. 1721765.4, filed Dec. 22, 2017, each of which is hereby fully incorporated herein by reference.

FIELD

The present disclosure relates to electronic vapor provision systems such as nicotine delivery systems (e.g. electronic cigarettes and the like).

BACKGROUND

Electronic vapor provision systems such as electronic cigarettes (e-cigarettes) generally contain a reservoir of a source liquid containing a formulation, typically including nicotine, from which a vapor or aerosol is generated, e.g. through heat vaporization. A vapor source for a vapor provision system may thus comprise a heater having a heating element arranged to receive source liquid from the reservoir, for example through wicking/capillary action. While a user inhales on the device, electrical power is supplied to the heating element to vaporize source liquid in the vicinity of the heating element to generate a vapor for inhalation by the user. Such devices are usually provided with one or more air inlet holes located away from a mouthpiece end of the system. When a user sucks on a mouthpiece connected to the mouthpiece end of the system, air is drawn in through the inlet holes and past the vapor source. There is a flow path connecting between the vapor source and an opening in the mouthpiece so that air drawn past the vapor source continues along the flow path to the mouthpiece opening, carrying some of the vapor from the vapor source with it. The vapor-carrying air exits the vapor provision system through the mouthpiece opening for inhalation by the user.

Some electronic cigarettes include means for allowing a user to control the operation of the e-cigarette. For instance, in some devices a button is provided in order to allow a user to selectively power the heating element, and thus generate aerosol, when the button is pressed. The user will press (and sometimes hold) the button typically either before the user starts sucking/inhaling on the e-cigarette or during in order to inhale the generated vapor/aerosol.

However, in order to provide users with more options for customizing their e-cigarette user experience, the number of functions of the e-cigarette that a user may wish to control increases. This can lead to an increased number of input mechanisms present on the e-cigarette and/or an increase in the complexity of operation of the input mechanisms. This can lead to users of the e-cigarettes being overwhelmed and not using (or simply not being aware) of some aspects of the functionality of the e-cigarette.

Moreover, some users may wish to customize their e-cigarette user experience multiple times during one use of the e-cigarette. In this case, the user is required to operate the input mechanisms on a regular basis, e.g., between puffs/inhalations, which can cause the user inconvenience during use of the e-cigarette.

Various approaches are described which seek to help address some of these issues.

SUMMARY

According to a first aspect of certain embodiments there is provided a vapor provision system for generating a vapor for user inhalation, the system comprising: a housing, a first user input mechanism configured to provide a first input to control a first aspect of vapor generation and located on a first side of the housing, and a second user input mechanism configured to provide a second input to control a second aspect of vapor generation and located on a second side of the housing, the second side of the housing opposite to the first side of the housing, wherein the first user input mechanism and the second user input mechanism are different types of user input mechanisms.

According to a second aspect of certain embodiments there is provided a vapor provision system for generating a vapor for user inhalation, the system comprising: a housing, a first user input means configured to provide a first input to control a first aspect of vapor generation and located on a first side of the housing, and a second user input means configured to provide a second input to control a second aspect of vapor generation and located on a second side of the housing, the second side of the housing opposite to the first side of the housing, wherein the second user input means is a different type of means to the first user input means.

It will be appreciated that features and aspects of the disclosure described above in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
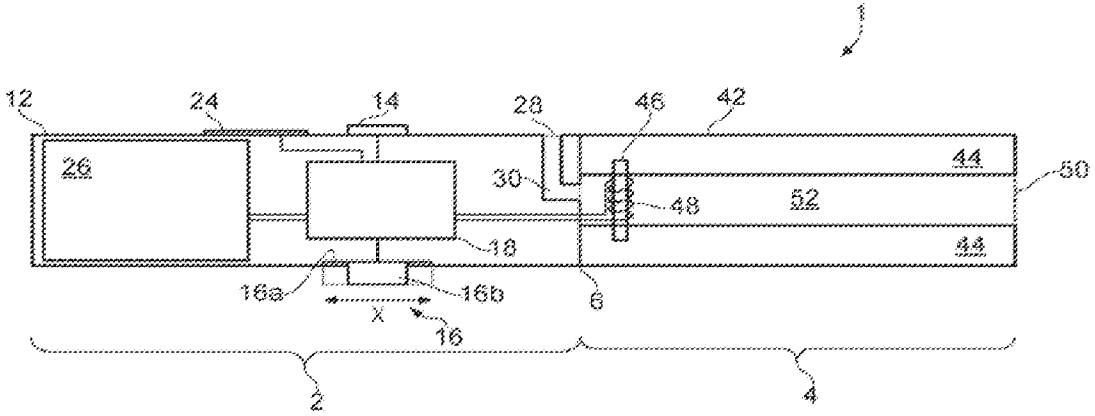
FIG. 1 represents in highly schematic cross-section a vapor provision system having ergonomically arranged first and second user input mechanisms for altering an aspect of vapor generation in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part and a replaceable (disposable) cartridge part. Often the replaceable cartridge part will comprise the vapor precursor material and the vaporizer and the reusable part will comprise the power supply (e.g. rechargeable battery) and control circuitry. It will be appreciated these different parts may comprise further elements depending on functionality. For example, the reusable device part will often comprise a user interface (which may include one or more user input mechanisms) for receiving user input and displaying operating status characteristics, and the replaceable cartridge part in some cases comprises a temperature sensor for helping to control temperature. Cartridges are electrically and mechanically coupled to a control unit for use, for example using a screw thread or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. It is common for electronic cigarettes to have a generally elongate shape. For the sake of providing a concrete example, certain embodiments of the disclosure described herein will be taken to comprise this kind of generally elongate two-part device employing disposable cartridges. However, it will be appreciated the underlying principles described herein may equally be adopted for different electronic cigarette configurations, for example single part devices or modular devices comprising more than two parts, refillable devices and single-use disposable devices, as well as devices conforming to other overall shapes, for example based on so-called box-mod high performance devices that typically have a more boxy shape. More generally, it will be appreciated certain embodiments of the disclosure are based on electronic cigarettes which are operationally configured to provide functionality in accordance with the principles described herein and the constructional aspects of the electronic cigarettes configured to provide the functionality in accordance with certain embodiments of the disclosure is not of primary significance.

Vapor provision systems in accordance with aspects of the present disclosure include a housing having a first user input mechanism arranged on a first side of the housing and a second user input mechanism arranged on the second side of the housing, wherein the first and second sides are opposite sides of the housing. The second user input mechanism is of a different type to the first user input mechanism, e.g., one is a button while the other is a slidable switch. Moreover, the second user input mechanism in some implementations is configured to allow a user to select any one of at least three input states. In this way, the user of such vapor provision devices is able to activate/actuate both the first and second user input mechanism simultaneously in order to control aspects of the vapor generation. That is, given the ergonomic arrangement of the first and second user input mechanism on opposite sides of the housing of the vapor provision system, the user is able to hold and operate the device using one hand in normal use, whereby the user can operate the first user input mechanism with their finger(s) and the second user input with their thumb while simultaneously holding/supporting the device. This provides the user with an intuitive and convenient way to operate the first and second user input mechanisms. The second user input mechanism may be configured to alter an aspect of the vapor generation depending upon the input state selected by the user (e.g., the volume/intensity of vapor generated per puff) and therefore the user is able to conveniently and quickly alter their smoking experience without moving the vapor provision device from their mouth (e.g., a normal position during use). More specific implementations of the principles of this disclosure will now be described in more detail below.

FIG. 1 is a cross-sectional view through an example e-cigarette 1 in accordance with certain embodiments of the disclosure. The e-cigarette 1 comprises two main components, namely a reusable part 2 and a replaceable/disposable cartridge part 4. In normal use the reusable part 2 and the cartridge part 4 are releasably coupled together at an interface 6. When the cartridge part is exhausted or the user simply wishes to switch to a different cartridge part, the cartridge part may be removed from the reusable part and a replacement cartridge part attached to the reusable part in its place. The interface 6 provides a structural, electrical and air path connection between the two parts and may be established in accordance with conventional techniques, for example based around a screw thread or bayonet fixing with appropriately arranged electrical contacts and openings for establishing the electrical connection and air path between the two parts as appropriate. The specific manner by which the cartridge part 4 mechanically mounts to the reusable part 2 is not significant to the principles described herein, but for the sake of a concrete example is assumed here to comprise a screw thread fitting (not represented in FIG. 1). It will also be appreciated the interface 6 in some implementations may not support an electrical and/or air path connection between the respective parts. For example, in some implementations a vaporizer may be provided in the reusable part rather than in the cartridge part, or the transfer of electrical power from the reusable part to the cartridge part may be wireless (e.g. based on electromagnetic induction), so that an electrical connection between the reusable part and the cartridge part is not needed. Furthermore, in some implementations the airflow through the electronic cigarette might not go through the reusable part so that an air path connection between the reusable part and the cartridge part is not needed.

The cartridge part 4 may in accordance with certain embodiments of the disclosure be broadly conventional. In FIG. 1, the cartridge part 4 comprises a cartridge housing 42 formed of a plastics material. The cartridge housing 42 supports other components of the cartridge part and provides the mechanical interface 6 with the reusable part 2. The cartridge housing is generally circularly symmetric about a longitudinal axis along which the cartridge part couples to the reusable part 2. In this example the cartridge part has a length of around 4 cm and a diameter of around 1.5 cm. However, it will be appreciated the specific geometry, and more generally the overall shapes and materials used, may be different in different implementations.

Within the cartridge housing 42 is a reservoir 44 that contains liquid vapor precursor material. The liquid vapor precursor material may be conventional, and may be referred to as e-liquid. The liquid reservoir 44 in this example has an annular shape with an outer wall defined by the cartridge housing 42 and an inner wall that defines an air path 52 through the cartridge part 4. The reservoir 44 is closed at each end with end walls to contain the e-liquid. The reservoir 44 may be formed in accordance with conventional techniques, for example it may comprise a plastics material and be integrally molded with the cartridge housing 42.

The cartridge part further comprises a wick 46 and a heater (vaporizer) 48 located towards an end of the reservoir 44 opposite to a mouthpiece outlet 50. In this example the wick 46 extends transversely across the cartridge air path 52 with its ends extending into the reservoir 44 of e-liquid through openings in the inner wall of the reservoir 44. The openings in the inner wall of the reservoir are sized to broadly match the dimensions of the wick 46 to provide a reasonable seal against leakage from the liquid reservoir into the cartridge air path without unduly compressing the wick, which may be detrimental to its fluid transfer performance.

The wick 46 and heater 48 are arranged in the cartridge air path 52 such that a region of the cartridge air path 52 around the wick 46 and heater 48 in effect defines a vaporization region for the cartridge part. E-liquid in the reservoir 44 infiltrates the wick 46 through the ends of the wick extending into the reservoir 44 and is drawn along the wick by surface tension/capillary action (i.e. wicking). The heater 48 in this example comprises an electrically resistive wire coiled around the wick 46. In this example the heater 48 comprises a nickel chrome alloy (Cr20Ni80) wire and the wick 46 comprises a glass fiber bundle, but it will be appreciated the specific vaporizer configuration is not significant to the principles described herein. In use electrical power may be supplied to the heater 48 to vaporize an amount of e-liquid (vapor precursor material) drawn to the vicinity of the heater 48 by the wick 46. Vaporized e-liquid may then become entrained in air drawn along the cartridge air path from the vaporization region towards the mouthpiece outlet 50 for user inhalation.

The reusable part 2 comprises an outer housing 12 having an opening that defines an air inlet 28 for the e-cigarette, a battery 26 for providing operating power for the electronic cigarette, control circuitry 18 for controlling and monitoring the operation of the electronic cigarette, a first user input mechanism 14, a second user input mechanism 16, and a visual display 24.

The outer housing 12 may be formed, for example, from a plastics or metallic material and in this example has a circular cross-section generally conforming to the shape and size of the cartridge part 4 so as to provide a smooth transition between the two parts at the interface 6. In this example the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 28 connects to an air path 30 through the reusable part 2. The reusable part air path 30 in turn connects to the cartridge air path 52 across the interface 6 when the reusable part 2 and cartridge part 4 are connected together. Thus, when a user inhales on the mouthpiece opening 50, air is drawn in through the air inlet 28, along the reusable part air path 30, across the interface 6, through the vapor generation region in the vicinity of the atomizer 48 (where vaporized e-liquid becomes entrained in the air flow), along the cartridge air path 52, and out through the mouthpiece opening 50 for user inhalation.

The battery 26 in this example is rechargeable and may be of a conventional type, for example of the kind normally used in electronic cigarettes and other applications requiring provision of relatively high currents over relatively short periods. The battery 26 may be recharged through a charging connector in the reusable part housing 12, for example a USB or microUSB connector.

The display 24 is provided to give a user a visual indication of various characteristics associated with the electronic cigarette, for example current power setting information, remaining battery power, and so forth. The display may be implemented in various ways. In this example the display 24 comprises a conventional pixilated LCD screen that may be driven to display the desired information in accordance with conventional techniques. In other implementations the display may comprise one or more discrete indicators, for example LEDs, that are arranged to display the desired information, for example through particular colors and/or flash sequences. More generally, the manner in which the display is provided and information is displayed to a user using the display is not significant to the principles described herein. For example some embodiments may not include a visual display and may include other means for providing a user with information relating to operating characteristics of the electronic cigarette, for example using audio signaling, or may not include any means for providing a user with information relating to operating characteristics of the electronic cigarette.

The control circuitry 18 is suitably configured/programmed to control the operation of the electronic cigarette to provide functionality in accordance with embodiments of the disclosure as described further herein, as well as for providing conventional operating functions of the electronic cigarette in line with the established techniques for controlling such devices. The control circuitry (processor circuitry) 18 may be considered to logically comprise various sub-units/circuitry elements associated with different aspects of the electronic cigarette's operation. In this example the control circuitry 18 is configured to control the supply of power from the battery 26 to the vaporizer 48 in response to user input, as well as other functional units/circuitry associated functionality in accordance with the principles described herein and conventional operating aspects of electronic cigarettes, such as display driving circuitry and user input detection circuitry (e.g., such as puff detection). It will be appreciated the functionality of the control circuitry 18 can be provided in various different ways, for example using one or more suitably programmed programmable computer(s) and/or one or more suitably configured application-specific integrated circuit(s)/circuitry/chip(s)/chipset(s) configured to provide the desired functionality.

The e-cigarette 1 of FIG. 1 includes a first user input mechanism 14 and a second user input mechanism 16, both of which enable a user to provide/select inputs for controlling or activating the e-cigarette 1, e.g., by providing suitable inputs to the control circuitry 18.

The first user input mechanism 14 is positioned on a first side of the reusable part housing 12, generally designated by 12*a*, while the second user input mechanism 16 is positioned on a second side of the of the reusable part housing 12, generally designated by 12*b*. As mentioned above, the e-cigarette 1 has a generally cylindrical shape and, when held in the mouth of a user (i.e., with mouthpiece opening 50 being inserted into the mouth of the user), the first side 12*a* of the reusable part housing 12 can be considered the upper/top side of the e-cigarette 1 while the second side 12*b* can be considered as the lower/bottom side of the e-cigarette 1. It should be appreciated that while the sides 12*a* and 12*b* are described as upper and lower respectively, this is not meant to limit the use of the e-cigarette 1 to this configuration. While this is generally considered herein as normal use of the e-cigarette 1, the user may decide to use the e-cigarette 1 when it is rotated 90° or 180° about its central longitudinal axis, in which case the sides 12*a* and 12*b* are no longer the upper and lower sides respectively. However, the principles of the present disclosure continue to apply in that the first and second user input mechanism 14, 16 are arranged on opposite sides of the e-cigarette 1.

The arrangement of the first and second user input mechanisms 14, 16 on opposite sides/surfaces of the reusable part housing 12 is such that the user can operate the user input mechanisms in a convenient manner—that is, the user input mechanisms are provided in an ergonomically suitable arrangement that do not require significant changes in position of the user's hands or of the e-cigarette 1 itself to be able to operate the user input mechanisms 14, 16. For instance, the user when holding the e-cigarette 1, can grip the reusable part 2 using their finger(s) and thumb in a pinching motion with their finger(s) positioned or resting on the upper side 12*a* and their thumb positioned on the lower side 12*b*. More specifically, the user's index finger in normal use contacts the first user input mechanism 14 while the user's thumb contacts the second user input mechanism 16. The remainder of the user's fingers may be rested on the upper side 12*a* of the reusable part housing 12 to help support/grip the e-cigarette 1 to increase stability during use, for example.

Accordingly, because the user input mechanisms 14, 16 are ergonomically arranged, the user is able to operate both the first and second user input mechanisms while simultaneously supporting/holding the e-cigarette 1 in a normal operating position. As the user inhales on the e-cigarette through mouthpiece opening 50, the user is able to operate either of the first or second user input mechanisms without significant adjustment to the positions of their finger(s) or thumb. The specific functions that can be attributed to the first and second user input mechanisms 14, 16 will be described in more detail below but, by way of example, the user may actuate the first user input mechanism to start or stop vapor generation, while the user may simultaneously actuate the second user input mechanism to adjust an aspect of the vapor generation, e.g., a quantity of vapor produced. The user is therefore not inconvenienced when providing an input via the first or second user input mechanisms and is able to customize their smoking experience with relative ease.

In the implementation shown, the first user input mechanism 14 comprises a push switch. The push switch has two states or positions that are switched between through actuation of the push switch; specifically an ON state/position and an OFF state/position. In this implementation, the first user input mechanism is configured to control the supply of power to the heating element 48; that is, whether power is supplied or not. In this implementation, this is considered to be a first aspect of the vapor generation. When the first user input mechanism is in the OFF state, the electronic cigarette is unable to generate vapor (i.e. the control circuitry 18 is prevented from supplying power to the vaporizer/heater in the OFF state). The electronic cigarette may, for example, be placed in the OFF state between use sessions, for example when the electronic cigarette might be set aside or placed in a user's pocket or bag. When the first user input mechanism 14 is in the ON (or active) state, the electronic cigarette is able to actively generate vapor (i.e. the control circuitry is capable of supplying power to the vaporizer/heater). The first user input mechanism 14 will thus typically be in the ON state when a user is in the process of inhaling vapor from the electronic cigarette.

The described push switch is biased into the OFF state and is transitioned to the ON state by a user applying a sufficient pressure downwards (i.e., in the direction towards the central longitudinal axis of the e-cigarette 1) using one or more fingers of the user's hand. This type of push switch is generally referred to as a push-to-make switch because the switch is pushed in order to complete the circuit (and thus allow current to flow).

The push switch may be of the temporary type or the latching type. Both types of switches are generally well-known and so only a brief description of their operation will be given here. A temporary push switch is one in which the user must continue to apply a sufficient pressure to the surface of the push switch to maintain the push switch in a given state (e.g., the ON state). Because the push switch is biased to the OFF state (e.g., using a suitable biasing member such as a spring which compresses as the user transitions the push switch from the OFF to the ON state), as soon as the user stops applying pressure and releases their finger(s) from the surface of the push switch, the push switch returns to the OFF state by releasing the compressed biasing member. Conversely, a latching push switch is one in which the switch is "latched" into the ON state once the user has actuated the push switch to the ON state. That is, even if the pressure applied by the user's finger to initially place the switch in the ON state is no longer applied, the switch remains in the ON state. To return the push switch to the OFF state, a user applies pressure to the push switch sufficient to release the latch. As the latch is released, the compressed biasing member returns the switch to the OFF state.

In the implementation described, the push switch is arranged such that the body of the push switch retreats (at least partially) into the reusable part 2 when a user applies pressure to the surface of the push switch. Accordingly, the reusable part 2 has a correspondingly shaped recess (not shown) into which the body of the push switch can be received. In the implementation shown in FIG. 1, the push switch is provided such that it protrudes from the surface of the reusable part housing 12, although in other implementations the push switch may be provided flush with the outer surface of the reusable part 2 when in the OFF state. It should be appreciated that the push switch may instead be formed from a flexible member (such as rubber) that compresses upon application of pressure from the user's finger(s) and thus is not (partially) received in the reusable part housing 12. The actual construction of the push switch is not significant to the present disclosure.

The second user input mechanism is a mechanism configured to allow a user to select a control input for controlling a second aspect of the vapor generation. In other words, a user can actuate the second user input mechanism from a first input state to a second input state, or from a second input state to a third input state. Each input state corresponds to a different control input that is used, e.g., by control circuitry 18, to control the vapor generation. For example, this may control the magnitude of the power supplied to the heater 48 (which subsequently varies the amount of vapor produced).

In the implementation described, the second user input mechanism 16 comprises a slide switch. The slide switch is generally formed of a track 16*a* along which an engagement part 16*b* (e.g., a rigid block) can be slid when a force is applied thereto by a user; specifically, a user's thumb. The slide switch is primarily positioned under the surface of the reusable part housing 12 as shown schematically in FIG. 1; however, in practice the surface of the reusable part housing 12 comprises a recess through which the engagement part 16*b* protrudes to enable a user's thumb for example to engage with the engagement part 16*b*. The recess is sized such that the engagement part 16*b* can be slid along the track 16*a* without obstruction. This is schematically represented in FIG. 1 by arrow X and the associated dotted lines which show the extent to which the engagement part 16*b* can be slid. In this implementation, the engagement part 16*b* can be positioned in one of four positions along the track 16*a*, where each position along the track 16*a* corresponds to a different input state of the slide switch; however, in other implementations the slide switch can be provided with any number of discrete states/positions (e.g., two, three, five, etc.) or can take any position along the track 16*a* (i.e., there are a continuous number of states that are selectable).

Figure 2:
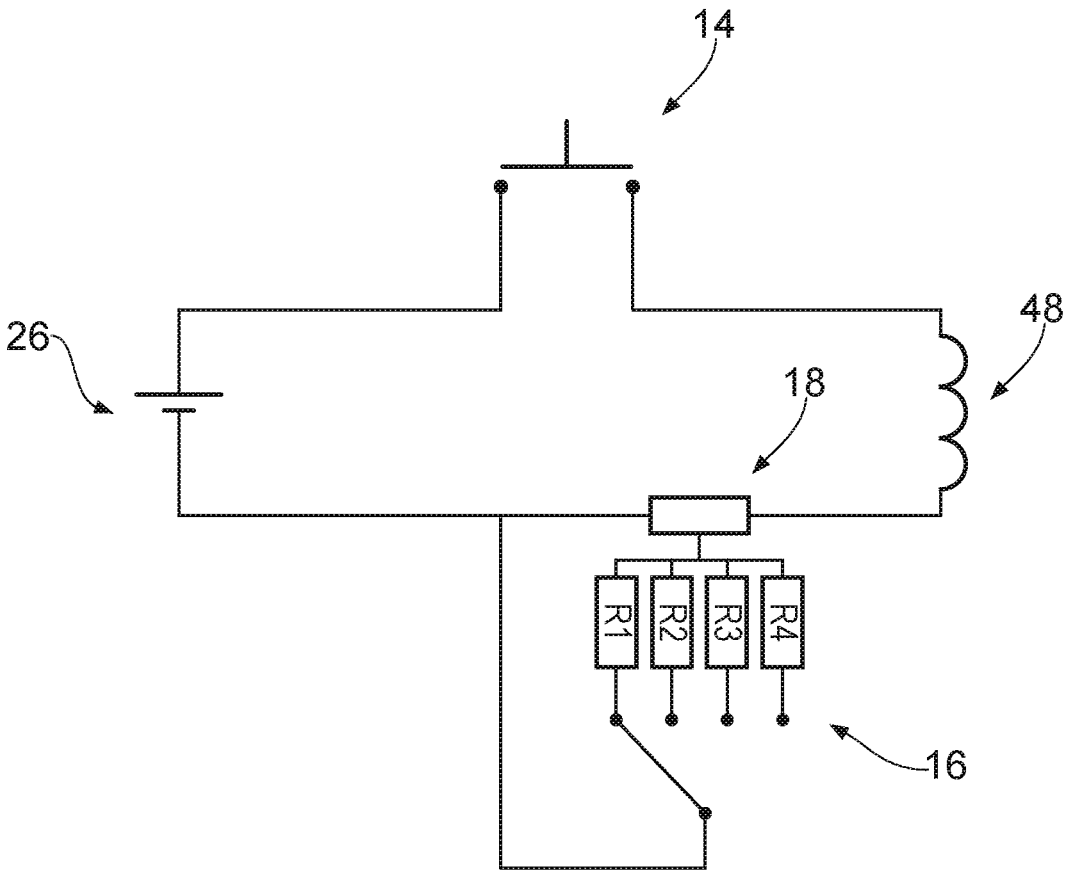
FIG. 2 represents in highly schematic form, an exemplary circuit diagram illustrating an implementation of the first and second user input mechanisms.

FIG. 2 schematically shows an example circuit diagram for the circuitry of the e-cigarette 1 in FIG. 1. The circuitry shown in FIG. 2 is highly simplified and many additional aspects that would appear in e-cigarette 1 of FIG. 1 have not been shown for reasons of clarity (e.g., circuitry relevant for operating display 24, for detecting any puffs/inhalations, for heater temperature regulation, etc.). The circuitry in FIG. 2 is only provided for the purposes of explaining the underlying concepts of the present disclosure and is not intended to represent the complete circuitry to be included in e-cigarette 1. Moreover, it will be apparent to the skilled person that alternative arrangements of the circuitry shown can also provide the same functionality as that described in FIG. 2. In essence, FIG. 2 shows an example of the circuitry relating only to the battery 26, heater 48, control circuitry 18, and first and second user input mechanisms 14, 16.

In the example circuitry shown in FIG. 2, the positive terminal of battery 26 is connected to a first terminal of the first user input mechanism 14, while the second terminal of the first user input mechanism 14 is connected to one end of the heater 48 which, in this implementation, is a length of resistance wire coiled about the wick 46 (not shown in FIG. 2). As seen in FIG. 2, the first and second terminals of the first user input mechanism 14, represented as a push switch, are not connected—hence the first user input mechanism 14 is in the OFF state and current is not permitted to flow to the heater 48 in this state. The other end of the heater 48 is connected to the control circuitry 18, schematically represented here as a box. The second user input mechanism 16, in this case, comprises four resistors each connected to a common output terminal that is in turn connected to the control circuitry 18. The negative terminal of battery 26 is connected to the input terminal of the second user input mechanism 16 and the control circuitry 18 such that the second user input mechanism 16 is connected in parallel with the control circuitry 18.

In FIG. 2, the second user input mechanism 16 is represented as a slide switch shown here as a switch connectable to any one of four resistors R1 to R4. In other words, the engagement part 16*b* of the second user input mechanism 16 can be slid along track 16*a* to a position corresponding to either R1, R2, R3, or R4 (i.e., one of four positions) at which the corresponding resistor is provided in electrical connection between the battery 26 and control circuitry 18. At each of the four positions on the track 16*a*, the common output terminal of the slidable switch is connected to the corresponding resistor.

Resistors R1 to R4 are provided with varying levels of resistance; in this specific example R1 has a greater resistance than R2, R2 has a greater resistance than R3, and R3 has a greater resistance than R4. For example, the resistors might be 1 k Ohm, 1.5 k Ohm, 2 k Ohm, and 2.5 k Ohm respectively, although other resistance values may be used. Accordingly, for a given voltage supplied by the battery 26, the power supplied to the control circuitry 18 which is connected in parallel with the second user input mechanism 16 is determined by which resistor the second user input mechanism 16 is connected to. This provides a control input to the control circuitry 18 in which control inputs associated with each of the states can be distinguished from one another (based on the resistance of the resistor connected to the control circuitry 18). The control circuitry 18 is provided with suitable detection circuitry to detect a change in the electrical properties of the control signal (e.g., electrical current). In this example, the control circuitry 18 is configured to adjust the power supplied to the heater 48, e.g., though pulse width modulation (PWM). On the basis of the control input, the control circuitry 18 changes the degree of modulation of the power/energy supplied to the heater, e.g., by changing the duty cycle. In this regard, it should be noted that while the average power supplied to the heater 48 is determined by the total PWM cycle, each pulse in the PWM cycle has the same magnitude. Therefore, each pulse represents an energy supplied to the heater, with the power being constant. However, for the purposes of this explanation, we refer to the average power supplied to the heater 48.

Specifically, in this simplistic representation, when the user input mechanism 16 is actuated to connect resistor R1 to the control circuitry 18, the control circuitry sets a duty cycle that delivers 0 W (or a very low power) to the heater 48. In this case, although the first user input mechanism 14 permits current to flow to the first heater, the control circuitry 18 sets the PWM duty cycle such that no power (or a very low level of power) is supplied to the heater 48. When the user input mechanism 16 is actuated to connect resistor R2 to the control circuitry 18, the control circuitry 18 sets a duty cycle that delivers 10 W to the heater 48. When the user input mechanism 16 is actuated to connect resistor R3 to the control circuitry 18, the control circuitry 18 sets a duty cycle that delivers 15 W to the heater 48. Finally, when the user input mechanism 16 is actuated to connect resistor R4 to the control circuitry 18, the control circuitry 18 sets a duty cycle that delivers 20 W to the heater 48. The duty cycle can be set in accordance with any suitable technique.

Therefore, when the user operates the second user input mechanism 16, the power supplied to the heater 48 can be changed to influence the generation of vapor for example, to change the quantity of vapor produced per puff. In general terms, by actuating the second user input mechanism 16, the user is able to set an aspect of the vapor generation. When the user sufficiently activates/presses the first user input mechanism 14, the circuit is completed and thus the power governed by the control input (selected according to resistor R1 to R4) is able to be provided to the heater 48.

It should also be appreciated that while the user is holding down/pressing/actuating the first user input mechanism 14, the user is also able to simultaneously actuate the second user input mechanism 16 to change the power supplied to the heater 48 (or more generally to adjust an aspect of the vapor generation). For example, a user may wish to use a relatively high level of power for vapor generation at the beginning of a use session, but to use a lower level of power for vapor generation towards the end of a use session. This is possible in part because of the ergonomic arrangement of the first and second user input mechanisms 14, 16 on opposite sides of the e-cigarette 1 that allows the user to operate both the first and second user input mechanisms simultaneously with a single hand. The user does not have to remove the device from their lips/mouth or to remove their finger(s)/thumb from the e-cigarette 1 to adjust the power supplied to the heater 48. Instead, the user can maintain pressure on the first user input mechanism 14 while simultaneously sliding their thumb to adjust the state of the second user input mechanism 16 (specifically by sliding the engagement part 16*b* thereof). This can allow not only the setting of a certain power prior to using the e-cigarette 1 but can also allow the adjustment of the power supplied to the heater (and thus the quantity of vapor generated) between puffs or even during puffs on the mouthpiece opening 50 of the e-cigarette 1. This offers the user a more convenient and intuitive way of customizing their smoking experience.

In the example implementation described, the first and second user input mechanisms 14, 16 are configured to provide a user input by mechanically altering the electrical circuitry within the e-cigarette 1. That is, the user input mechanisms 14, 16 described are generally switches which either complete/make an electronic connection or alter the physical pathway of the circuitry (e.g., by changing the connected resistor).

However, in other implementations, the e-cigarette 1 comprises a first activation sensor for detecting user activation (i.e. pressing) of the first user input mechanism 14 and a second activation sensor for detecting user activation (i.e. sliding) of the second user input mechanism 16. In other words, the first and second user input mechanisms are configured to communicate with activation sensors which then output detection signals for controlling the e-cigarette. Such activation sensors may form part of the control circuitry 18 or may be physically separate from, but in communication with, the control circuitry 18. In this case, the control circuitry 18 is configured to control a supply of power from the battery 26 to the heater 48 to generate vapor from a portion of the e-liquid in the cartridge part 4 for user inhalation via the mouthpiece outlet 50 in response to the detection signals output from the first or second activation sensors. The way in which the first and second user input mechanisms 14, 16 interact with the activation sensors is not particularly significant to the principles of the present disclosure. For example, the activation sensors may be configured to detect and identify each of the positions/states/ of the respective user input mechanisms and output a control signal/input to the control circuitry 18, or the activation sensors may alternatively be configured to detect a change in the position/state of the user input mechanism and determine the current state based on the previous state. Alternatively, in some implementations, the activation sensors may be receivers configured to receive a signal wirelessly transmitted from the user input mechanisms (or associated transmitter provided therewith) and subsequently pass the received signal to the control circuitry 18 as the control input.

The type of user input mechanism is not specific for the principles of the present disclosure. However, the two user input mechanisms are of different types, which means that more ergonomically friendly user input mechanisms for the user's hand position when holding the e-cigarette 1 can be disposed at suitable locations of the e-cigarette 1. This enables a user to activate both user input mechanisms with relative ease when holding the device with one hand by providing user input mechanisms which are suitable for the position of the fingers/thumb. This will vary depending upon the overall shape of the e-cigarette 1 and how a user naturally holds/grasps such an e-cigarette 1.

As mentioned above, the first and second user input mechanisms 14, 16 may be mechanical switches that alter physical connections within the circuitry/wiring of the e-cigarette 1. Alternatively, the user input mechanisms 14, 16 may be switches provided in combination with suitable activation sensors for sensing when the switches are activated/change state. Equally, the first and second user input mechanisms may comprise any suitable form of sensor that can be used, in combination with a suitable activation sensor, for detecting a user input. For example, the first user input mechanism may comprise a capacitive sensor/temperature sensor/pressure sensor for sensing the presence of the user's finger. The associated first activation sensor is configured to identify the presence of the user's finger (e.g., by comparing capacitance values detected by the capacitive sensor) and outputs a corresponding control input to be used by the control circuitry 18 to allow the supply of power to the heater 48. In this case, if the user removes their finger from the sensor, the associated activation sensor stops sending the control input which causes power to stop being supplied to the heater 48. In other implementations, the activation sensor is configured to sense a magnitude of the sensed signal and determine a user input based on the magnitude of the sensed signal. For example, in the case of a pressure sensor as the second user input mechanism 16, no pressure may indicate an OFF state, a small pressure applied by the user's thumb may indicate the 10 W state, a medium pressure applied may indicate the 15 W state, and a large pressure applied may indicate the 20 W state.

It should be appreciated that the first and second user input mechanisms 14, 16 may be any of the aforementioned switches/sensors and they do not have to be the same type of switch/sensor. For example, the first user input mechanism 14 may comprise a capacitive sensor and associated activation sensor, while the second user input mechanism 16 may comprise the mechanical slide switch described in FIG. 2. Any combination of the mechanical type switches and the switches/sensors providing a control input may be used in accordance with the principles of the present disclosure.

It has been described above that the quantity (aspect) of vapor generation is controlled on the basis of a total power or energy that is supplied to the heater. That is, the user can select the 20 W state of the second user input mechanism 16 in order to set the power supplied to the heater as 20 W. The power is generally proportional to the temperature which, in turn, may be proportional to the quantity of vapor generated. However, in other implementations the user may instead input an indication of the desired temperature, e.g., 150° C. In this case, the control circuitry 18 regulates the power supplied to the heater 48 to achieve the desired temperature of the heater 48 (hence the power supplied to the heater 48 may be altered even if the state of the second user input mechanism is not altered). The e-cigarette 1 may include a temperature sensor in order to provide a temperature reading of the heater 48 to the control circuitry 18. Accordingly, the control circuitry 18 changes the power/energy supplied to the heater 48 based on the temperature reading.

While it has generally been described above that the temperature of the heater 48 is adjusted in order to influence the quantity of vapor generated by the e-cigarette 1 (based on either a constant or variable power supply to the heater), it should be understood that other aspects of vapor generation can be set/altered by adjusting the second user input mechanism 16. For example, in some implementations the e-cigarette 1 is provided with more than one heater and the second user input mechanism 16 is a switch that determines the total number of heaters to be activated. That is, suppose there are a total of four heaters in the e-cigarette 1, then the second user input mechanism 16 can set whether one, two, three, or four of the heaters are activated upon pressing the first user input mechanism 14. The heaters may be configured to heat the same vapor precursor material or may be configured to heat different precursor materials, e.g., of different flavors.

In other implementations, the second user input mechanism 16 is configured to adjust other aspects of vapor generation, such as the airflow through the e-cigarette. This may be by means of providing a control input to the control circuitry 18 to adjust a valve or other mechanism for increasing or restricting airflow through the e-cigarette 1. That is, the second user input mechanism 16 provides an electrical control signal as an output which is subsequently used by the control circuitry 18 to control an aspect of the vapor generation (which may include changing the airflow through the device, selecting a heater heating profile, flavor selection, etc.). Alternatively, the second user input mechanism 16 is configured to directly control a mechanical valve or the like for increasing or restricting airflow through the device. That is, the second user input mechanism 16 provides a mechanical output in which actuation of the second user input mechanism is directly linked with mechanical movement of certain components within the e-cigarette 1.

In essence, the aspect of vapor generation that the second user input mechanism 16 is configured to set or adjust is not significant for the principles of the present disclosure. Indeed, any factor or parameter that may influence an aspect of the vapor generation can be controlled by the second user input mechanism in order to provide the user with vapor generation they can control simultaneously with activation of the vapor generation can be used in accordance with the principles of the present disclosure.

It has generally been described that the first user input mechanism 14 is a push switch, and specifically a push-to-make switch. However, in other implementations, the first user input mechanism may be any suitable user input mechanism that provides at least an ON and an OFF state. For example, suitable switches may be a two-state rocker switch (as described later with respect to FIGS. 3 and 4), a toggle switch, a rotary switch, or any other suitable electrical switch. Equally, depending upon the way in which the circuitry within the e-cigarette 1 is arranged, the push switch may alternatively be a push-to-break switch in which the electrical connection is broken when the switch is in the ON state.

Moreover, in other implementations the first user input mechanism 14 has more than two states, e.g., an OFF, 50% and 100% state, which may be realized by a three-state rocker switch, for example. This may provide complementary functionality with the second user input mechanism—for example, the first user input mechanism may control the energy supply to the heater (with the OFF state supplying no energy, the 50% state supplying half the maximum energy and the 100% state supplying maximum energy) while the second user input mechanism is configured to control airflow through the device. In this way, the user can have a more flexibility when setting/adjusting aspects of vapor generation.

While the second user input mechanism 16 has generally been represented by a slidable switch having four states in FIG. 2, it should also be appreciated that in other implementations the second user input mechanism 16 is a user input mechanism that can take any number of states. For example the second user input mechanism may be a slidable switch having two, three, five, or more states. In other implementations, the second user input mechanism 16 is configured to take any position on a continuous spectrum of positions. For example, the second user input mechanism may be a variable resistor or potentiometer that provides a resistance value that varies in a continuous manner (as opposed to a stepwise manner) when actuated by the user. As the user slides the engagement part **16*b* along the track 16*a*, the resistance varies (linearly or logarithmically) with the position of the engagement part 16*b* along the track 16*a***. Such an arrangement provides the user with more flexibility in controlling an aspect of vapor generation as it allows for a finer control of the aspect of vapor generation. It should be understood that the exact construction of the second user input mechanism is not significant for the principles of the present disclosure.

With regards to battery 26, in some other implementations the battery 26 is instead replaced by or provided in combination with an external power source, e.g., external power supplied via a microUSB cable from a computer or wall socket or the like. Appropriate switching circuitry may be provided in order to switch between battery 26 or an external power source as the power source for heater 48—said switching circuitry may be incorporated in, or controlled by, control circuitry 18. Additionally, it should also be noted that control circuitry 18 may be configured to control the charging of the battery 26 from the external power source.

FIGS. 3 and 4 schematically show a variety of views of a second example e-cigarette 101 in accordance with the principles of the present disclosure.

Figures 3A, 3B, 3C, 3D:
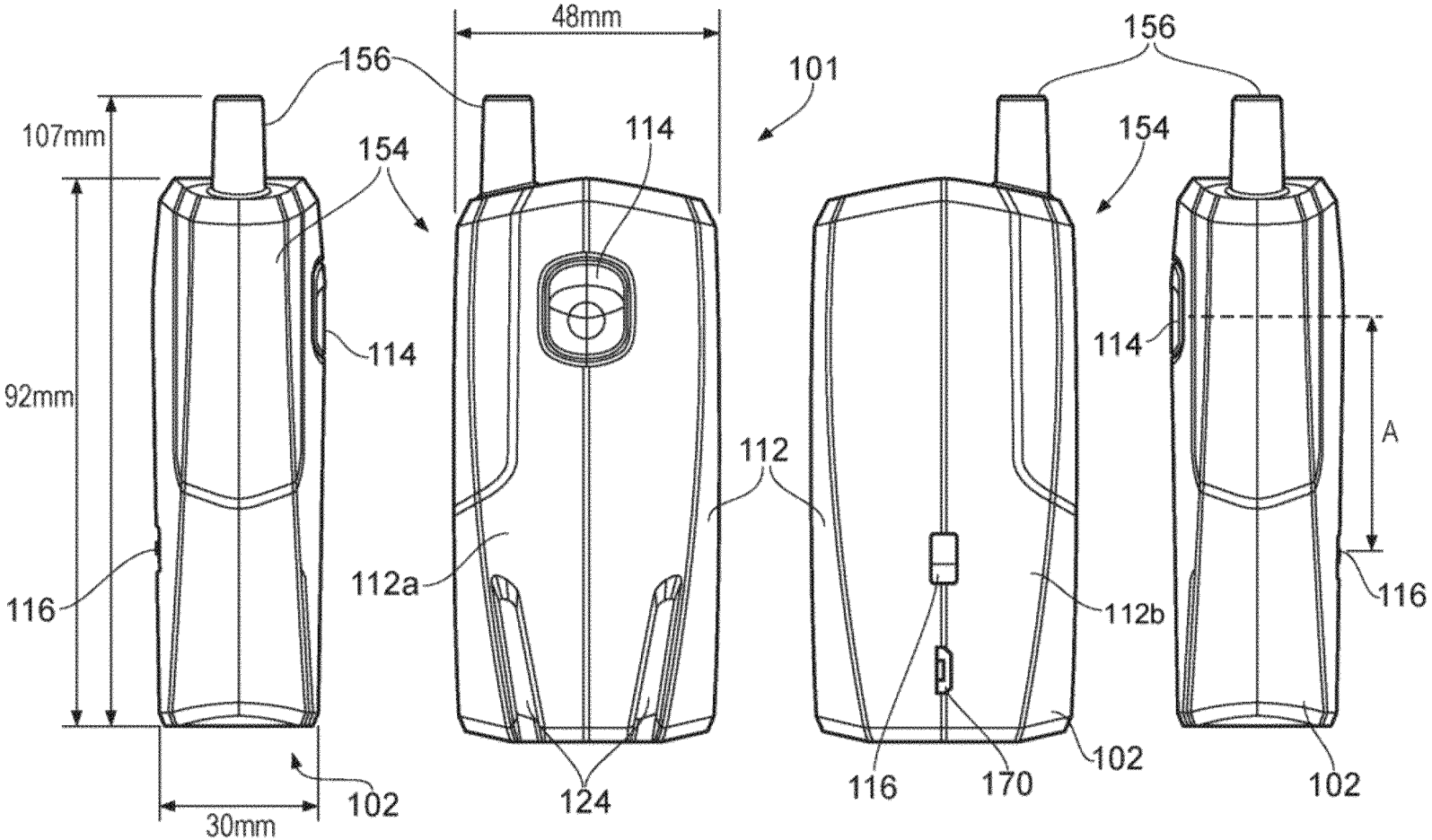
FIG. 3*a* schematically represents a vapor provision system having ergonomically arranged first and second user input mechanisms for altering an aspect of vapor generation as viewed from the right hand side in accordance with certain other embodiments of the disclosure.
FIG. 3*b* schematically represents the vapor provision system of FIG. 3*a* as viewed from a top/upper/front side.
FIG. 3*c* schematically represents the vapor provision system of FIG. 3*a* as viewed from a bottom/lower/back side.
FIG. 3*d* schematically represents the vapor provision system of FIG. 3*a* as viewed from a left hand side.

FIG. **3*a* schematically shows a view of the e-cigarette 101 as viewed from a side (right hand side) of the e-cigarette. FIG. 3*b* schematically shows a view of the e-cigarette 101 as viewed from a top/upper/front side of the e-cigarette 101, while FIG. 3*c* schematically shows a view of the e-cigarette 101 as viewed from a bottom/lower/back side of the e-cigarette 101. FIG. 3*d* schematically shows a view of the e-cigarette 101 as viewed from a side (left hand side) of the e-cigarette 101**.

Figure 4A:
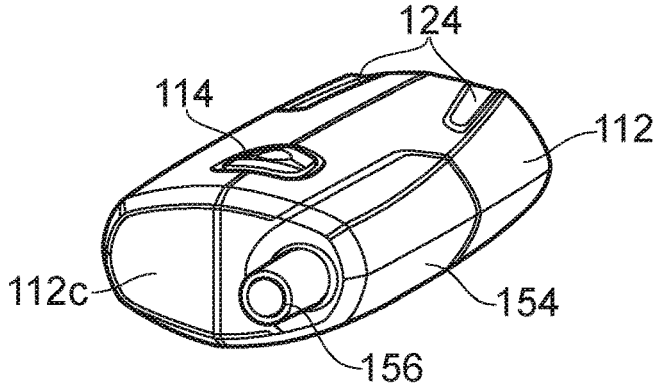
FIG. 4*a* schematically represents a mouthpiece end and top/upper/front side of the vapor provision system of FIG. 3*a* as viewed primarily from a user-facing side.
Figure 4C:
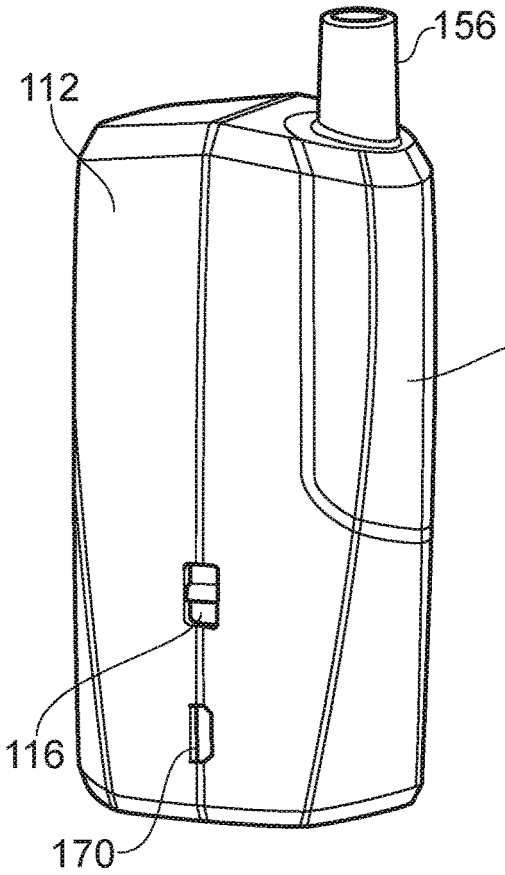
FIG. 4*c* schematically represents the bottom/lower/back side and right side of the vapor provision system of FIG. 3*a* as viewed primarily from the bottom/lower/back side and right side.
Figure 4B:
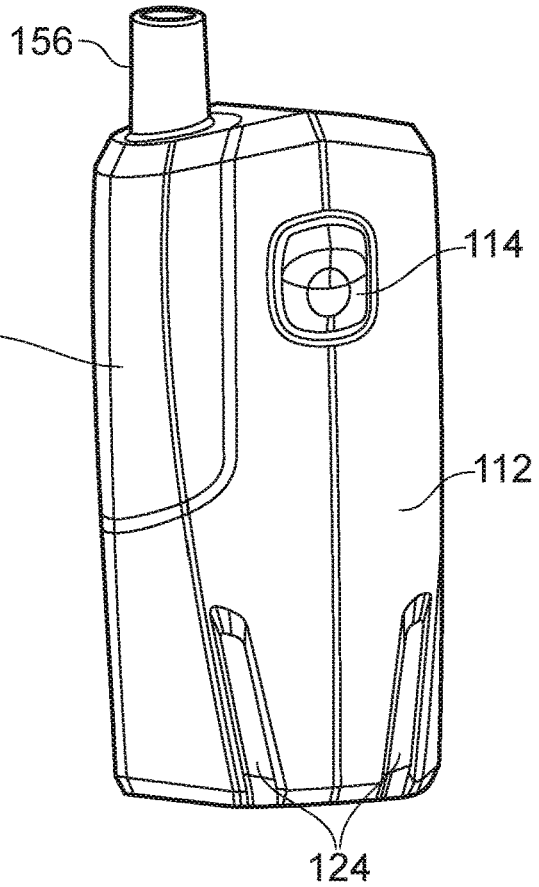
FIG. 4*b* schematically represents the top/upper/front side and right side of the vapor provision system of FIG. 3*a* as viewed primarily from the top/upper/front side and right side.
Figure 4D:
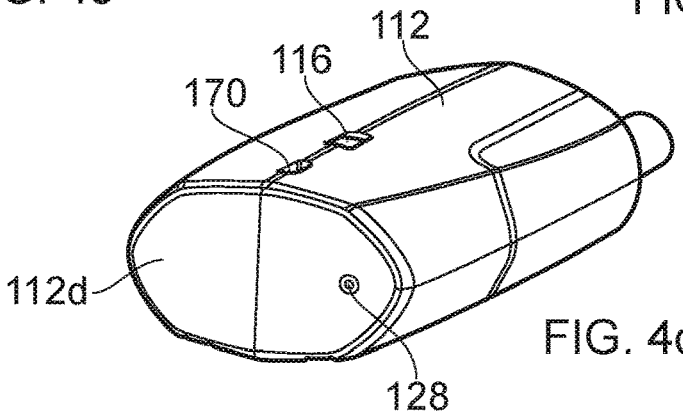
FIG. 4*d* schematically represents a side opposite the user-facing side of the vapor provision system of FIG. 3*a* and bottom/lower side of the vapor provision system of FIG. 3*a* as viewed primarily from the side opposite the user-facing side.

FIG. **4*a* schematically shows a perspective view of the mouthpiece end 156 and top/upper/front side of the e-cigarette 101 as viewed primarily from a user-facing side of the e-cigarette 101. FIG. 4*b* schematically shows a perspective view of the top/upper/front side and right side of the e-cigarette 101 as viewed primarily from the top/upper/front side and right side of the e-cigarette 101. FIG. 4***c* schematically shows a perspective view of the bottom/lower/back side and right side of the e-cigarette 101 as viewed primarily from the bottom/lower/back side and right side of the e-cigarette 101. FIG. 4*d* schematically shows a perspective view of a side opposite the user-facing side of the e-cigarette 101 and bottom/lower side of the e-cigarette 101 as viewed primarily from the side opposite the user-facing side of the e-cigarette 101.

FIGS. 3 and 4 schematically show an example vapor provision system/e-cigarette 101 that represents a variation of the e-cigarette 1 represented in FIG. 1 in accordance with certain other embodiments of the disclosure. The electronic cigarette 101 represented in FIGS. 3 and 4 differs from the electronic cigarette 1 represented in FIG. 1 primarily in a structural manner. As shown, the e-cigarette 101 of FIGS. 3 and 4 includes a reusable part 102 and a cover 154. The reusable part 102 is substantially similar to the reusable part 2 of FIG. 1 in that it includes a reusable part housing 112, a battery (not shown), control circuitry (not shown), first user input mechanism 114, second user input mechanism 116, a display 124, and an air inlet 128 and air path (not shown). The battery, control circuitry, first user input mechanism 114, second user input mechanism 116, display 124, and air inlet 128 are substantially the same, in terms of functionality, as their corresponding counterparts described in FIG. 1. A repetition of the details of these components is not repeated here and instead the reader is referred back to the previous discussion of the functionality of these components. However, it should be appreciated that these components may have a different physical form from the counterparts described in relation to FIG. 1. Any relevant changes in physical form are described in more detail below.

In this regard, the e-cigarette 101 generally has a cuboidal shape having a characteristic extent in the length direction of 92 mm, a characteristic extent in the width direction of 48 mm, and a characteristic extent in the thickness direction of 30 mm. As discussed in more detail below, the cover 154 includes a mouthpiece end 156 and, when the cover is engaged with the reusable part housing 112, increases the characteristic extent of the e-cigarette 101 to 107 mm. It should be appreciated that the above characteristic extents are exemplary only and in other implementations the characteristic extents can be greater or small than described. For instance, the characteristic extent in the thickness direction can be selected from the group comprising: less than or equal to 10 cm, less than or equal to 7 cm, less than or equal to 5 cm, less than or equal to 4 cm, or less than or equal to 3 cm.

The cuboidal shape of the e-cigarette 101 is curved/rounded in the width direction along the edges running parallel to the longitudinal direction. The curved parts form the left and right sides of the e-cigarette 101, while the flatter sides having the greater surface area form the front and back sides of the e-cigarette 101. The front side is defined here as the side comprising the first user input mechanism 114 (and is shown predominately in FIG. 3*b*), with the side to the left of FIG. 3*b* being defined as the right side of the e-cigarette 101 (shown in FIG. 3*a*) and the side to the right in FIG. 3*b* being defined as the left side of the e-cigarette 101 (shin in FIG. 3*d*). The other large area side shown in FIG. 3*c* is defined as the back side of the e-cigarette 101.

The reusable part housing 112 is provided with a recess (not shown) on the right side of the device sized to receive the cover 154. The cover 154 is configured to be inserted into the reusable part housing 112 and, when completely engaged with the recess, matches and completes the outer contours of the reusable part housing 112 to provide the generally cuboidal shape. The cover 154 includes an integrally formed mouthpiece end 156 which is effectively a cylindrical tube that provides fluid communication with the underside of the cover 154 (i.e., the non-visible side of cover 154 in FIGS. 3 and 4). As mentioned, the cover 154 is removable from the reusable part 102 and can be removed by sliding away from the reusable part in a direction along a central axis of the generally circular mouthpiece end 156.

The cover 154, when removed, reveals a cartridge part, which may be substantially similar to cartridge part 4 shown in FIG. 1. That is, the aforementioned cartridge part 4 of e-cigarette 1 may be inserted into the reusable part 102 of e-cigarette 101 and connected thereto, before being covered with cover 154. The mouthpiece end 156 forms an air-tight connection with mouthpiece opening 50 to enable vapor generated by the heater 48 to pass from the cartridge part 4 through mouthpiece end 156 to the user when the user inhales on the e-cigarette 101. It should be understood that the outer shape of the cartridge part 4 may, however, be altered in order to be appropriately accommodated within the reusable part 102 and covered by the cover 154; for example, the cartridge part may be tapered towards the mouthpiece opening 50. The cartridge part 4 is able to be connected to the air inlet 128 via a suitable air path (not shown) in a similar manner to air path 30 in FIG. 1, thereby allowing air to pass through the cartridge part 4 and mix with any generated vapor before passing to the user (in a broadly similar manner to that described with respect to FIG. 1).

The e-cigarette 101 includes a first user input mechanism 114 provided on the front side of the e-cigarette, and a second user input mechanism 116 provided on the back side of the e-cigarette 101. In normal use, the user will place mouthpiece end 156 in their mouth while having the front side facing upwards and the back side facing downwards (i.e., towards the ground when the user is in a standing or upright position). Therefore, using similar terminology to that used to described e-cigarette 1, the front side may be referred to as the first side 112*a* of the reusable part housing 12 and can be considered as the upper/top side of the e-cigarette 1 while the back side may be referred to as the second side 112*b* and can be considered as the lower/bottom side of the e-cigarette 1. It should be appreciated that while the sides 112*a* and 112*b* are described as upper and lower respectively, this is not meant to limit the use of the e-cigarette 101 to this configuration. While this arrangement is generally considered herein as normal use of the e-cigarette 101, the user may decide to use the e-cigarette 1 when it is rotated 90° or 180° about its central longitudinal axis, in which case the sides 112*a* and 112*b* are no longer the upper and lower sides respectively. However, the principles of the present disclosure continue to apply in that the first and second user input mechanisms 114, 116 are arranged on opposite sides of the e-cigarette 101.

The e-cigarette 101 includes a first user input mechanism 114 provided on the front side 112*a* of the e-cigarette, and a second user input mechanism 116 provided on the back side 112*b* of the e-cigarette 101. In normal use, the user will place mouthpiece end 156 in their mouth while having the front side facing upwards and the back side facing downwards (i.e., towards the ground when the user is in a standing or upright position). Therefore, using similar terminology to that used to described e-cigarette 1, the front side may be referred to as the first side 112*a* of the reusable part housing 12 and can be considered as the upper/top side of the e-cigarette 1 while the back side may be referred to as the second side 112*b* and can be considered as the lower/bottom side of the e-cigarette 1. It should be appreciated that while the sides 112*a* and 112*b* are described as upper and lower respectively, this is not meant to limit the use of the e-cigarette 101 to this configuration. While this arrangement is generally considered herein as normal use of the e-cigarette 101, the user may decide to use the e-cigarette 1 when it is rotated 90° or 180° about its central longitudinal axis, in which case the sides 112*a* and 112*b* are no longer the upper and lower sides respectively. However, the principles of the present disclosure continue to apply in that the first and second user input mechanisms 114, 116 are arranged on opposite sides of the e-cigarette 101.

The first user input mechanism 114 in this implementation is a two-state push switch biased to the OFF state. The push switch is also provided as a temporary switch where the user must continue to apply pressure to the surface of the push switch to maintain the switch in the ON state. The push switch is configured to activate vapor generation such that, when a user presses on the push switch and inhales on the mouthpiece end 156 (and assuming the second user input is set to any state that is not an OFF condition), power/energy is supplied to the heater 48 to cause vapor to be generated which can be inhaled by the user through mouthpiece opening 50 and mouthpiece end 156.

The second user input mechanism 116 in this implementation is a four-state slide switch, having OFF, 10 W, 15 W, and 20 W states. As before, the user is able to select any of these states to influence the vapor generation by choosing the power/energy to be supplied to the heater 48, whereby the greater the power selected by the second user input mechanism 116, the more vapor that is produced per puff. As described in relation to FIGS. 1 and 2, this may be performed either prior to inhaling on the mouthpiece end 156 of the e-cigarette 101 or as the user is using the e-cigarette 101 (that is, simultaneously with actuation of the first user input mechanism 114). The specific manner in which the second user input mechanism 116 influences the vapor generation can be any of those discussed previously in relation to FIGS. 1 and 2; that is, via altering a resistance of the wire between heater 48 and battery 26, varying the duty cycle of a pulse width/frequency modulation technique, etc.

As seen in FIGS. 3 and 4, the first and second user input mechanisms 114, 116 are provided on opposite sides of the reusable part housing 112. Moreover, the first and second user input mechanisms 114, 116 are provided on their respective sides such that the longitudinal axes of the user input mechanisms 114, 116 broadly align with the longitudinal axis of the e-cigarette 101. In other words, the first and second user input mechanisms 114, 116 are provided approximately centrally in the width direction of the e-cigarette 101. However, as seen best in FIG. 3*d*, the first and second user input mechanisms 114, 116 are offset from each other by a distance A in the length direction.

In FIG. 3*d*, the first and second user input mechanisms 114, 116 are offset by approximately 45 mm (that is, A=45 mm) with the first user input mechanism 114 being closer to the mouthpiece end 156 than the second user input mechanism 116. The positions of the first and second user input mechanisms 114, 116 are ergonomically chosen to correspond to the positions of the user's finger(s) or thumb when the user is gripping the e-cigarette 101 during normal use. As discussed with respect to e-cigarette 1, the user does not have to remove the device from their lips/mouth lips/mouth or to remove their finger(s)/thumb from the e-cigarette 101 to adjust the power/energy supplied to the heater 48. Instead, the user can maintain pressure on the first user input mechanism 114 while simultaneously sliding/moving their thumb to adjust the state of the second user input mechanism 116. This can allow not only the setting of a certain power/energy prior to using the e-cigarette 101 but can also allow the adjustment of the power/energy supplied to the heater (and thus the quantity of vapor generated) between puffs or even during puffs on the mouthpiece end 156 of the e-cigarette 101. This offers the user a more convenient and intuitive way of customizing their smoking experience.

However, it should be appreciated that in other implementations of e-cigarettes, the first and second user input mechanisms 114, 116 may be offset by a greater or smaller amount than 45 mm, and that the second user input mechanism 116 may be closer to the mouthpiece end 156 than the first user input mechanism 114. In essence, the offset is such that the first and second user input mechanism 114, 116 are provided at ergonomically suitable positions on opposite sides of the e-cigarette 101 such that a user can simultaneously hold the e-cigarette and operate both user input mechanisms in a convenient manner (i.e., with one hand). Equally, the first and second user input mechanisms 114, 116 in some implementations are provided offset from each other in the width direction (that is, parallel to but offset from the central longitudinal axis of the e-cigarette) for substantially similar reasons. Further, it may be that the first and second user input mechanisms 114, 116 are comprised of first and second regions which are activatable by the user. These regions may "overlap" in the sense that a region on one side of the device maps onto the input mechanism or region on the other side of the device. Such a configuration may provide greater flexibility as to the actual location of the first and second user input mechanism 114, 116. For example, it may be that each of the first and second user input mechanism 114, 116 is formed from a touch sensitive region, where the user can touch any part of the region in order to activate it. In such an embodiment, the user has the greatest degree of ergonomic freedom since they can activate ether input mechanism anywhere on the first and second regions. This allows for a single device to be provided regardless of the different sizes of hands that may ultimately hold the device.

The reusable part housing 112 is a four-piece construction in this implementation. The reusable part 112 housing comprises a first half and a second half which, when pressed together, form the front 112*a*, back 112*b*, left and right sides of the reusable part housing 112. In this regard, each half of the reusable part housing 112 comprises a respective flat large area side (i.e., front side 112*a* or back side 112*b*) and half of the left and right sides of the e-cigarette 101. Therefore, the two halves join together in a plane parallel to both the length and width directions of the e-cigarette 101. The reusable part housing 112 also comprises a user-facing side 112*c* and an opposite side 112*d* that also form the four-piece construction of the reusable part housing 112. The user-facing side 112*c* is the side of the e-cigarette 101 that faces the user in normal use and is generally orthogonal to the longitudinal axis of the e-cigarette 101. Hence, when the cover 124 is engaged with the reusable part housing 112, the mouthpiece end 156 and the user-facing side 112*c* are what the user sees as they move the e-cigarette 101 towards their mouth. The opposite side 112*d* is provided opposite the user-facing side 112*c* at the opposite end of the e-cigarette 101 and includes the air inlet 128 (see FIG. 4*d*). That is, the user facing side 112*c* and the opposite side 112*d* form the ends of the e-cigarette in the length direction. The four-piece construction of the e-cigarette 101 is achieved by snap fitting and/or gluing the four pieces described above together. The four prices of the reusable part housing 112 are formed from a plastic material using suitable forming techniques, e.g., injection molding. However, it should be understood that the housing 112 can be formed from any other suitable materials (e.g., metals). Additionally, although the reusable part housing 112 is formed as a four-piece construction, in other implementations the reusable part housing may be constructed from more of fewer than four-pieces (e.g., a three-piece construction, five-piece construction, etc.). In the implementation shown, the display 124 includes two LED light strips provided substantially parallel to the length direction of the e-cigarette 101. The display 124 is configured to illuminate when the user is inhaling on the mouthpiece end 156. The display may, in some implementations, be governed by the state of the first user input mechanism 114. That is, if the first user input mechanism 114 is in the OFF state, the LED light strips will not illuminate to indicate a puff regardless of whether or not the user inhales on the mouthpiece end 156. The LED light strips in this case are only illuminated when both the user is inhaling on the mouthpiece 156 and the first user input mechanism is in the ON state. The LED light strips in some implementations are further configured to indicate other parameters associated with the e-cigarette 101—for example, the LEDs may illuminate red when the battery is low and green when it has sufficient charge, or they may illuminate a color associated with a particular flavor of e-liquid in the cartridge (e.g., yellow for banana, pink for strawberry, etc.) to inform the user or other users of what flavor is currently loaded in the e-cigarette 101. It should also be understood that the LED light strips may pulse depending upon the current use of the e-cigarette 101. For example, if the e-cigarette 101 is not being used, the display 124 may pulse slowly (e.g., at a frequency of 0.5 Hz) to indicate battery status while the display may be on constantly when the user inhales on the e-cigarette 101. Alternatively, in some further implementations, there is provided a third user input mechanism that, when pressed by the user causes the display 124 to activate—in these implementations the display 124 is not illuminated until the third user input mechanism is actuated, regardless of the user inhaling on the e-cigarette 101 or the first user input mechanism 114 being actuated.

FIGS. 3 and 4 also show a charging port 170 (specifically a microUSB port) for charging the battery (not shown) stored in reusable part 102. To charge the e-cigarette 101, the user plugs a suitable microUSB cable into the port and connects the other end to a power source (e.g., a computer of a mains plug adapter). Control circuitry (not shown but equivalent in functionality to control circuitry 18) may include circuitry configured to direct power from the charging port 170 to the battery. Alternatively, the control circuitry may direct current to the heater in order to allow use of the e-cigarette using the external power source.

It will be appreciated the vapor provision system and processing discussed above in relation to FIGS. 1 to 4 may be modified in various ways for different implementations.

For example, in this example implementations it is assumed power is supplied to the heater whenever a user is actuating the first user input mechanism 14, 114. However, in other implementations the electronic cigarette may further include an inhalation sensor, for example a pressure sensor, configured to detect when a user is actively inhaling on the electronic cigarette. In such cases the control circuitry may be configured to only supply power to the heater in response to user activation of the first user input mechanism when the inhalation sensor detects the user is actively inhaling on the electronic cigarette. That is, vapor generation is dependent upon both the first user input mechanism being in the ON state and the user inhaling on the e-cigarette. In such cases, the power/energy is supplied to the heater for so long as the user continues inhaling. If the second user input mechanism is actuated while the user is inhaling vapor from the e-cigarette, then as before, actuation of the second user input mechanism will adjust an aspect of the vapor generation. While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on devices having an electrical heater based vaporizer for heating a liquid vapor precursor material, the same principles may be adopted in accordance with vaporizers based on other technologies, for example piezoelectric vibrator based vaporizers or optical heating vaporizers, and also devices based on other vapor precursor materials, for example solid materials, such as plant derived materials, such as tobacco derivative materials, or other forms of vapor precursor materials, such as gel, paste or foam based vapor precursor materials.

While the e-cigarettes 1 and 101 have been described as a generally cylindrical shape and a generally cuboidal shape respectively, in other implementations, the e-cigarettes take different shapes. For example, the e-cigarettes may take the general shape of a triangular prism, a pentagonal or greater sided polygonal prism, a pebble shape, etc. Regardless of the specific shape of the e-cigarette 1, 101, the positions of the first and second user input mechanisms 114, 116 are provided on opposite sides of the e-cigarette at ergonomically suitable positions for that specific shape of the e-cigarette. In this way, whatever the shape of the e-cigarette, the user is able to conveniently actuate both the first and second user input mechanisms simultaneously to both generate vapor and adjust an aspect of the vapor generation.

Thus, there has been described a vapor provision system for generating a vapor for user inhalation, the system comprising a housing, a first user input mechanism configured to provide a first input to control a first aspect of vapor generation and located on a first side of the housing, and a second user input mechanism configured to provide a second input to control a second aspect of vapor generation and located on a second side of the housing. The second side of the housing is opposite to the first side of the housing. The first user input mechanism and the second user input mechanism are different types of user input mechanisms.

While the above described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision system for generating a vapor for user inhalation, comprising:

a housing;

a first user input mechanism configured to provide a first input to control a first aspect of vapor generation and located on a first side of the housing;

a second user input mechanism configured to provide a second input to control a second aspect of vapor generation and located on a second side of the housing, the second side of the housing opposite to the first side of the housing, wherein the first user input mechanism and the second user input mechanism are different types of user input mechanisms; and wherein activation of the first user input mechanism is configured to activate vapor generation by the vapor provision system as the first aspect of the vapor generation and activation of the second user input mechanism simultaneously with activation of the first user input mechanism is configured to modify an aspect of the vapor generation as the second aspect of the vapor generation.

2. The vapor provision system of claim 1, wherein the second user input mechanism is configured to provide at least three different control inputs.

3. The vapor provision system of claim 1, wherein the first input mechanism comprises a push switch and the second user input mechanism comprises a slidable switch.

4. The vapor provision system of claim 1, wherein the first user input mechanism comprises a switch having two distinct input states corresponding to different control inputs and the second user input mechanism comprises a switch having at least three input states corresponding to different control inputs, wherein each of the at least three input states is configured to influence an aspect of the vapor generation.

5. The vapor provision system of claim 1, wherein activation of the first user input mechanism is configured to activate vapor generation by the vapor provision system as the first aspect of vapor generation and activation of the second user input mechanism is configured to set an aspect of the vapor generation as the second aspect of vapor generation.

6. The vapor provision system of claim 4, wherein the second aspect of vapor generation includes a magnitude of power capable of being supplied to a heater of the vapor provision system or an operating temperature of the heater.

7. The vapor provision system of claim 4, wherein the second aspect of vapor generation includes airflow through the vapor provision system.

8. The vapor provision system of claim 4, wherein the vapor provision system includes a plurality of heaters and the second aspect of vapor generation includes selecting to provide power to any one or more of the plurality of heaters.

9. The vapor provision system of claim 1, wherein the first user input mechanism and the second user input mechanism are arranged on the respective first side and second side of the housing such that the user is able to actuate both the first user input mechanism and the second user input mechanism with a single hand during normal use of the vapor provision system.

10. The vapor provision system of claim 1, wherein the first side of the housing is an upper side of the vapor provision system and the second side of the housing is a lower side of the vapor provision system when held to a mouth of the user in normal use.

11. The vapor provision system of claim 1, wherein the first user input mechanism and the second user input mechanism are separated from one another by at least 45 mm along an axis of extent of the vapor provision system.

12. The vapor provision system of claim 1, wherein the first user input mechanism and the second user input mechanism are located along a central longitudinal axis of the respective first side and the second side of the housing.

13. The vapor provision system of claim 1, wherein a thickness of the vapor provision system is selected from the group consisting of less than 10 cm, less than 7 cm, less than or equal to 5 cm, less than or equal to 4 cm, and less than or equal to 3 cm.

14. A vapor provision system for generating a vapor for user inhalation, comprising:

a housing;

a first user input means configured to provide a first input to control a first aspect of vapor generation and located on a first side of the housing; and a second user input means configured to provide a second input to control a second aspect of vapor generation and located on a second side of the housing, the second side of the housing opposite to the first side of the housing, wherein the second user input means is a different type of means than the first user input means, and wherein activation of the first user input means is configured to activate vapor generation by the vapor provision system as the first aspect of the vapor generation and activation of the second user input means simultaneously with activation of the first user input means is configured to modify an aspect of the vapor generation as the second aspect of the vapor generation.

* * * * *